US009934764B2

(12) United States Patent
Jones

(10) Patent No.: US 9,934,764 B2
(45) Date of Patent: Apr. 3, 2018

(54) SYSTEMS AND METHODS FOR MANAGEMENT OF PERCUSSION ACCESSORIES

(71) Applicant: Keith Jones, Rancho Cucamonga, CA (US)

(72) Inventor: Keith Jones, Rancho Cucamonga, CA (US)

( * ) Notice: Subject to any disclaimer, the term of this patent is extended or adjusted under 35 U.S.C. 154(b) by 0 days.

(21) Appl. No.: 15/183,773

(22) Filed: Jun. 15, 2016

(65) Prior Publication Data

US 2017/0365241 A1 Dec. 21, 2017

(51) Int. Cl.
*G10D 13/00* (2006.01)

(52) U.S. Cl.
CPC ..... *G10D 13/00* (2013.01)

(58) Field of Classification Search
CPC ..... G10D 13/026; G10D 13/023; G10G 5/00
USPC ..... 84/411 R, 421, 453, 458
See application file for complete search history.

(56) References Cited

U.S. PATENT DOCUMENTS

| | | | | |
|---|---|---|---|---|
| D346,100 | S | 4/1994 | Behrenfeld | |
| 5,392,681 | A | 2/1995 | Hall | |
| 6,686,527 | B2 | 2/2004 | Hagiwara | |
| 8,791,347 | B1 | 7/2014 | Christian | |
| 2005/0056137 | A1 | 3/2005 | DiPietro | |
| 2005/0072292 | A1* | 4/2005 | Ellestad | G09B 15/06 84/485 R |
| 2012/0229235 | A1* | 9/2012 | Fullerton | G09F 7/04 335/285 |
| 2014/0165819 | A1 | 6/2014 | McGee et al. | |

FOREIGN PATENT DOCUMENTS

| | | | | |
|---|---|---|---|---|
| DE | 20206104 A | * | 4/2002 | G10D 13/02 |
| DE | 202 06 104 U1 | | 9/2002 | |

OTHER PUBLICATIONS

Evans Magnetic Drum Key, Online publication: remo.com, May 26, 2016, website: www.musiciansfriend.com/drums-percussion/evans-magnetic-drum-key.
Quicktech Drum Key, Online publication: musiciansfriend.com, May 26, 2016, website: remo.com/products/product/quicktech-drum-key/.
DE 202 06 104 U1, Wester, English translation.

* cited by examiner

*Primary Examiner* — Kimberly Lockett
(74) *Attorney, Agent, or Firm* — Blair Walker IP Services, LLC

(57) ABSTRACT

A drum tuning key includes a body having a longitudinal axis, a first end and a second end, the first end including a keyed interface configured to releaseably engage an element of a tuning assembly of a drum for cooperative rotation therewith and the second end including a radially-extending portion configured to be manipulated by a user to apply a torque in relation to the longitudinal axis to operate the tuning assembly, and a magnet carried by the body and having a first end, a second end, and an axis of magnetization extending between the first end and the second end, wherein at least one of the first end or the second end of the magnet is located at or adjacent an outer surface of the body.

33 Claims, 5 Drawing Sheets

SYSTEMS AND METHODS FOR MANAGEMENT OF PERCUSSION ACCESSORIES

FIELD OF THE INVENTION

The field of the invention generally relates to devices for use with musical instruments, including drums and percussion instruments.

BACKGROUND

Drummers and percussionists of play a variety of different instruments. A drummer playing a drum set may sit or stand behind a single drum, cymbal, or percussion instrument, or behind an array of one or more snare drums, tom toms, bass drums, cymbals, including hi-hat cymbals, and other percussion instruments. Percussionists may sit or stand behind a single percussion instrument, or behind an array of one or more percussion instruments, including drums including bongos, congas, or timbales, or cowbells, agogô bells, gongs, cajones, or many other instruments.

Some of the musical instruments described require implements or tools to maintain, clean or tune them. One example is a drum tuning key, or drum key, which is typically configured to adjust the tightness of a drum head against a drum shell, often by adjusting the distance between a drum rim (or hoop) and the drum shell. Some drums include several tension rods (also called, tuning rods, tuning bolts, or tension screws) which insert through holes in the drum rim and have a threaded end and an opposing head. The opposing head has a diameter larger than the hole in the drum rim and/or it includes a washer that has a diameter larger than the hole in the drum rim, so that the threaded end of the tension rod can be threadingly engaged with an inner thread of a tension casing (sometimes called lugs) and the head of the tension rod can be turned (e.g., by engaging a drum tuning key), thus moving the rim closer to the drum shell, thereby tightening the drum head. Drums may have three or more tension rod/tension casing combinations. Some tension casings are configured to couple to a single drum head and some tension casings are configured to couple to two drum heads, such as a top drum head and a bottom drum head. Each drum head may be tightened (or loosened) using the drum tuning key in order to adjust the pitch of the drum, or to equilibrate the tightness in the drum head among each of several tension rod locations. The adjustment in the tightness of the drum head (and thus its resonant frequency) may also be done to minimize (or in some cases even maximize) the amount "buzz," "rattle," or noise that other sounds of varying frequencies may cause in the drum head. Each drum may have three or more locations around the perimeter of the rim/drum head wherein the adjustment occurs. Often a drum has between about five and eighteen tension rods per drum head or between about eight and ten. Each tension rod may be adjusted individually, often in a star pattern. Other products have been proposed or developed to turn all tuning rods simultaneously, but these products are expensive, bulky, and have not been shown to be reliable, for example, at achieving a reliable equilibrium of pitch around the circumference of the drum head.

A drummer or percussionist may need to quickly tune or retune drums at any time, for example, at various times during a recording session or during a performance. The small size of most drum tuning keys makes them prone to being lost or misplaced if placed around a few or several drums or percussion instruments. Not only do the instruments have additional bulk due to hardware and stands, but often in recording or performance situations, there are also a number of microphones, microphone stands and electrical wires. Some drummers or percussionists leave a drum tuning key engaged with a tuning rod while playing. A tuning key on a mostly horizontal drum, such as a floor tom, may be used, and a relatively remote location, such as a tuning rod on the far side of the drum, may be chosen, to lessen the likelihood that the drum tuning key will be hit and potentially displaced by a drumstick while the drummer or percussionist is playing. However, often, the vibration of the drum alone is enough to cause the drum tuning key to fall off of its position on the turning rod. Furthermore, even if the drum tuning key does not fall off, its typically loose or slightly loose engagement with the tuning rod commonly makes an undesired rattling noise which is not only perceivable in well-miked studio or performance venue environments, but is also perceivable by a player playing on an unmiked drum, for example at a casual setting (e.g., home).

SUMMARY OF THE INVENTION

In a first embodiment of the invention, a drum tuning key includes a body having a longitudinal axis, a first end and a second end, the first end including a keyed interface configured to releaseably engage an element of a tuning assembly of a drum for cooperative rotation therewith and the second end including a radially-extending portion configured to be manipulated by a user to apply a torque in relation to the longitudinal axis to operate the tuning assembly, and a magnet carried by the body and having a first end, a second end, and an axis of magnetization extending between the first end and the second end, wherein at least one of the first end or the second end of the magnet is located at or adjacent an outer surface of the body.

DETAILED DESCRIPTION

Embodiments of the disclosure include apparatus for magnetically coupling implements related to musical instruments, such as a drum tuning key, onto portions of musical instruments or onto associated equipment containing at least some ferrous metal. Because the implement is coupled magnetically, it may be removed cleanly, quickly and easily for use, and may be returned to its coupled location only by placing it in proximity to the location. The magnetic coupling applies a normal force between the implement and the element onto which it is coupled that is sufficient to maintain the implement in position for easy awareness of its location and easy access.

Figure 1:
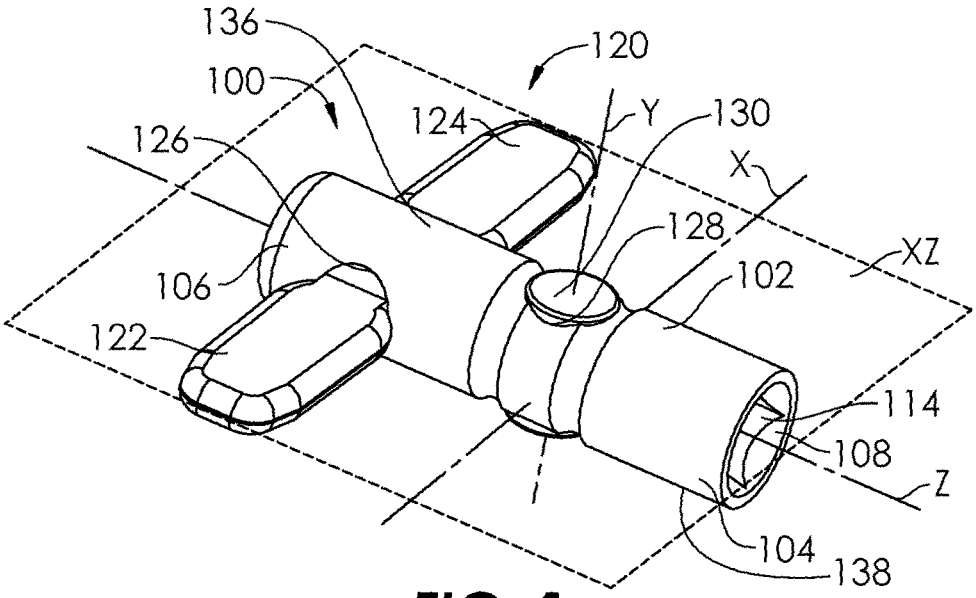
FIG. 1 is a perspective view of a drum tuning key according to an embodiment of the disclosure.

A drum tuning key 100 is shown in FIG. 1, and comprises a body 102 having a first end 104 and a second end 106, and extending along a longitudinal axis Z. At or adjacent the first end 104 is an interface 108 which is configured to engage an element in a tuning assembly of a drum. The tuning assembly may be configured similar to a tuning assembly 112 of the snare drum 110 of FIG. 8B, or may comprise a different type of tuning assembly. As shown in FIG. 1, the interface 108 includes a cavity 114 having a substantially square cross-section. The cavity 114 is configured to engage with a head of a tension rod of a tuning assembly of a drum. For example, the cavity 114 may engage with a square-shaped head 116 of a tension rod 118 in the tuning assembly 112 of the snare drum 110 of FIG. 8B. Though square shapes are commonly used on drum tuning keys and on the corresponding or mating heads of tension rods, other noncircular shapes may be used, such as hexagonal, oval, rectangular, other polygonal, or Torx® (registered trademark of Acument Intellectual Properties, LLC, Troy, Mich., USA). Any shape may be used such that a torque may be imparted by the drum tuning key 100 in both a clockwise and counterclockwise manner onto the tension rod 118 (or on an analogous element of any type of tuning assembly) via the head 116, thus providing an attachable and detachable, keyed coupling between the drum tuning key 100 and the tension rod 118. In order to allow a user to apply a sufficient torque onto the tension rod 118, a radially-extending portion 120 is carried on the drum tuning key 100 at the second end 106 of the body 102. In the embodiment of FIG. 1 the radially-extending portion 120 comprises a first wing 122 and a second wing 124, each wing 122, 124 extending from the body 102 in generally opposite directions. Each wing 122, 124 may extend from the body in a direction which is substantially perpendicular to the longitudinal axis Z, as shown in FIG. 1. The wings 122, 124 are configured to be grasped or manipulated by a user's hand and may be formed integral with the body 102 by a process which may include machining, casting, metal injection molding, or other processes. In FIG. 1, however, the body 102 includes a first transverse hole 126 for insertion of the wings 122, 124, either separately or together as a single unit. The wings 122, 124 may be formed as a single piece that inserts through the first transverse hole 126 and is interference fit, welded, brazed, soldered, adhesively or epoxy bonded, or otherwise attached to the body 102. The body 102 and the wings 122, 124 may be formed from a number of magnetic or non-magnetic materials including steel, stainless steel (e.g., 400 series, 300 series), titanium, and may be plated, coated or embedded with non-corrosive or wear-resistant materials. In some embodiments, the body 102 and the wings 122, 124 comprise steel and are chrome-plated. In some embodiments, the body 102 and wings 122, 124 comprise titanium and are anodized. In some embodiments, at least the portion which comprises the keyed walls of the cavity 114 is selected from a material that has a hardness which is at least slightly less than the hardness of the material of the head 116 of a tension rod 118, so that the drum tuning key 100 does not damage the head 116 of the tuning rod 118. However, in other cases, a more robust cavity wall material may be desired, with the tension rod 118 being the replaceable element, and thus the walls of the cavity 114 may comprise a material equal or greater in hardness to that of the head 116 of the tuning rod 118.

Figure 2:
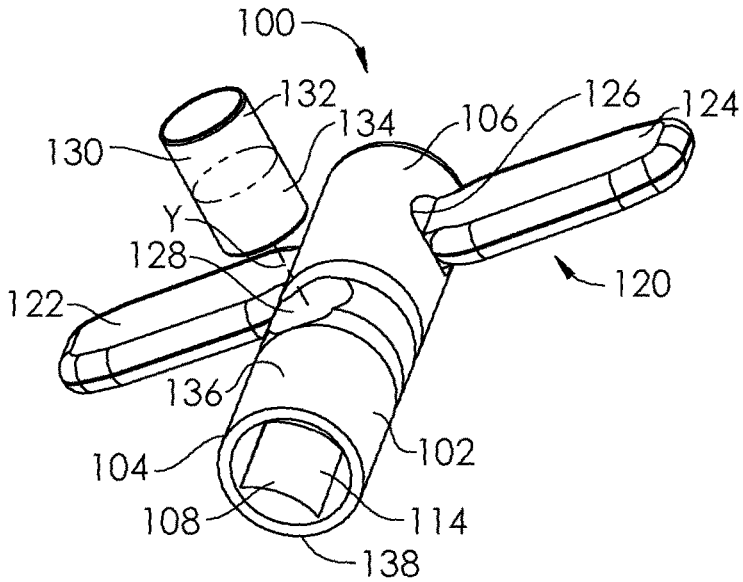
FIG. 2 is an exploded view of the drum tuning key of FIG. 1.
Figure 3:
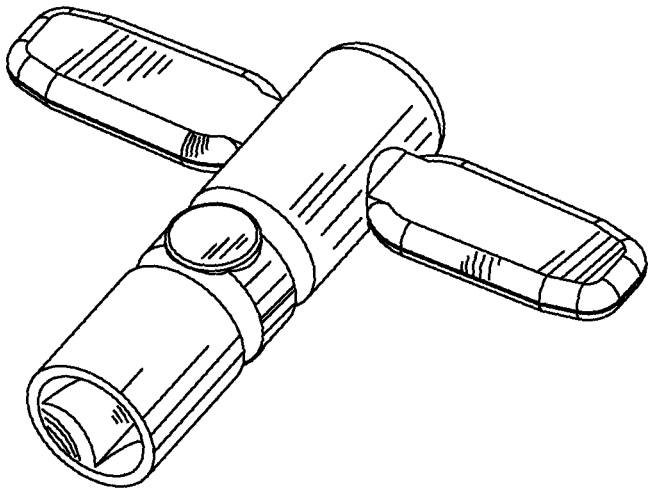
FIG. 3 is a top, front perspective view of the drum tuning key of FIG. 1.
Figure 4:
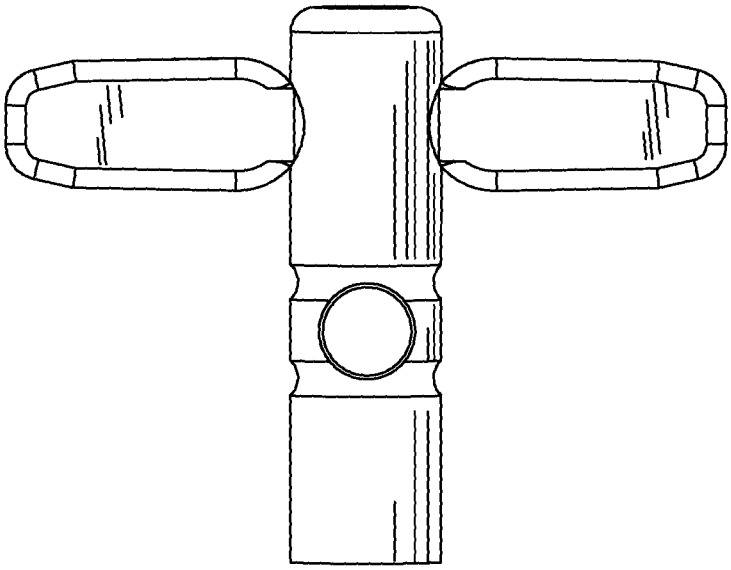
FIG. 4 is a bottom view of the drum tuning key of FIG. 1.
Figure 5:
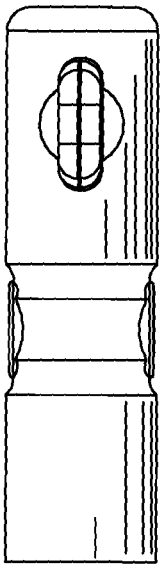
FIG. 5 is a side view of the drum tuning key of FIG. 1, wherein both sides are symmetrical.
Figure 6:
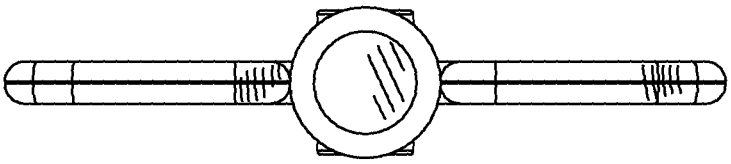
FIG. 6 is a rear view of the drum tuning key of FIG. 1.
Figure 7:
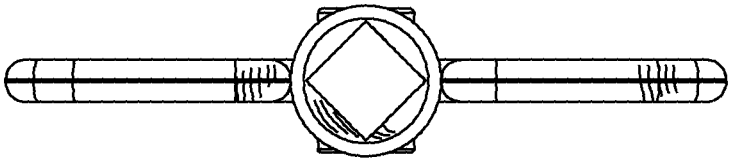
FIG. 7 is a front view of the drum tuning key of FIG. 1.

As shown in FIG. 1, the body 102 further comprises a second transverse hole 128 which may pass partially or completely through the body 102. A magnet 130 having a north pole 132 and a south pole 134 (shown in FIG. 2) is secured within the second transverse hole 128. The magnet 130 is magnetized along an axis Y, such that the poles 132, 134 are oriented transversely to the body 102. For example, when the magnet 130 is secured within the second transverse hole 128 of the body 102, the axis Y is substantially perpendicular to the longitudinal axis Z. The magnet 130 may be secured to the body 102 by adhesive, epoxy, mechanical engagement/lock, or a friction fit with the second transverse hole 128. The magnet may comprise a rare earth metal, including neodymium-iron-boron (sometimes abbreviated as a "neodymium magnet") or samarium-cobalt. A corrosion-resistant coating or plating may be applied to the magnet 130, such as nickel, nickel-copper-nickel, zinc, tin, or gold. These materials may also provide a better surface for adhesive of epoxy bonding. The magnet 130 is shown in FIGS. 1-2 as a cylindrical, axially magnetized (or axially-poled) magnet, such that when the magnet 130 is secured in place within the second transverse hole 128, an upper surface 136 or a lower surface 138 of the drum tuning key 100 will be forced against a surface due to the attraction of the magnet 130 to ferrous metal, such as the ferrous metal found in drum and cymbal hardware (percussion hardware), drum rims, certain ferrous metal drum shells, and drum thrones (stools), as well as other items. Alternatively, the magnet 130 may also be configured in a disk shape or a non-cylindrical shape, including a square cross-section rod or a cube or other shape. The second transverse hole 128 may be shaped to conform to the shape of the magnet 130. An axis X is shown passing through the midline of the body 102 at the location of the magnet 130. The wings 122, 124 of the drum tuning key 100 are configured so that the drum tuning key 100 forms a generally planar configuration, bisected more or less by plane XZ, which includes both axis X and longitudinal axis Z. The planar shape of the drum tuning key 100 not only allows it to be less bulky, but also allows it to reside in somewhat flush condition when it is magnetically coupled to a ferrous metal portion of percussion hardware.

FIGS. 3-7 illustrate a series of views of an ornamental design for the drum tuning key 100.

Figure 8A:
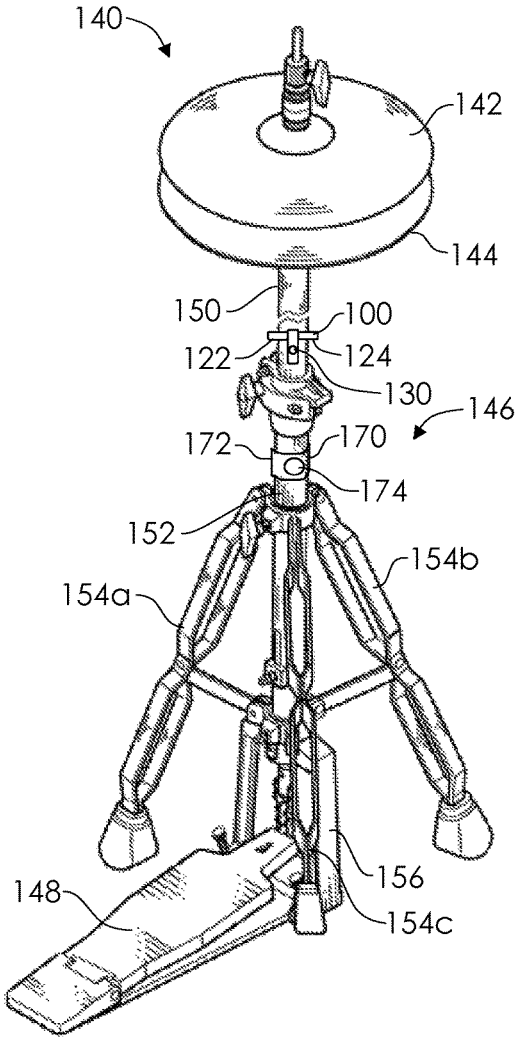
FIG. 8A is a perspective view of a hi-hat assembly according to an embodiment of the disclosure.

Turning to FIG. 8A, a hi-hat assembly 140 includes a top cymbal 142, a bottom cymbal 144, and a hi-hat stand 146. The hi-hat stand 146 is configured to be foot-operated via a pedal 148 which allows a percussionist to open and close the cymbals 142, 144 in relation to each other. The stand 146 includes one or more tubular members 150, 152 and legs 154*a*, 154*b*, 154*c*. The pedal 148 is movably held to the stand 146 by a frame 156. The drum tuning key 100 is shown magnetically coupled to tubular member 150. The tubular member 150 is constructed at least partially of a ferrous metal which attracts the magnet 130 of the drum tuning key 100. The magnet 130 has enough magnetic field strength (usually measured in Tesla) such that the drum tuning key 100 contacts the tubular member 150 with a large enough surface magnetic pull force (e.g., normal force) so that the related frictional force between the material of the body 102 and/or magnet 130 and/or wing 122, 124 and the tubular member 150 is greater than the weight (force due to gravity) of the drum tuning key 100. In other words, the drum tuning key 100 does not fall. The magnetic field strength is also sufficient so that normal vibration or slight movement of the stand 146 is not able to knock the drum tuning key 150 off of the tubular member 150. Yet the drum tuning key 100 can be easily grasped by the user and pulled off of the tubular member 150. In some embodiments, the magnet 130 is configured with a magnetic pull of about five pounds (22.2 Newton) or greater. In other embodiments the magnet 130 is configured with a magnetic pull of about nine pounds (40.0 Newton) or greater. In other embodiments the magnet 130 is configured with a magnetic pull of between about nine pounds (40.0 Newton) and about fifteen pounds (66.7 Newton). In some embodiments, the magnetic field strength of the magnet 130 is at least about 0.7 Tesla. In some embodiments, the magnetic field strength of the magnet 130 is at least about 1.4 Tesla. In some embodiments, the magnetic field strength is between about 0.7 Tesla and about 2.0 Tesla. In some embodiments, the magnetic field strength is between about 1.0 Tesla and about 1.6 Tesla. In some embodiments, the magnet 130 comprises neodymium-iron-boron having a grade of between 35 and 52 (N35 and N52). In some embodiments, the magnet 130 comprises neodymium-iron-boron having a grade of between 45 and 52 (N45 and N52). In a particular embodiment, the magnet has a diameter of 0.250 inches (6.35 mm) and a length of 0.375 inches (9.53 mm), and a total geometric volume of about 300 $mm^3$. In some embodiments, the magnet has a total geometric volume of at least about 250 $mm^3$. In some embodiments, the magnet has a total geometric volume of between about 250 $mm^3$ and about 350 $mm^3$.

Any portion of the stand 146 of the hi-hat assembly 140 may comprise a ferrous metal to which the magnet 130 of the drum tuning key 100 is magnetically attracted. The ferrous metal of the stand 146 or other percussion hardware may include, but is not limited to, chrome-plated steel, stainless steel (e.g., 400 series), cast iron, or wrought iron. Even if the hardware is constructed of less magnetic materials or non-magnetic materials, a plate or block comprising a sufficiently magnetic ferrous material may be attached at a desired location. The plate or block of ferrous metal may, for example, be at least about 100 grams. As shown in FIG. 8A, the percussionist may place the drum tuning key 100 at any particular location that is the most efficient to store and retrieve the drum tuning key 100. In a typical, left side hi-hat location on a drum set or drum kit, to location of the drum tuning key 100 in FIG. 8A is toward the percussionist and towards the inside, and thus very accessible. However, the drum tuning key 100 is far enough below the bottom cymbal 144 and above the pedal 148, that rattling cymbals 142, 144, the moving pedal 148, and moving drumsticks (not shown) will not knock it out of place. The magnetic coupling to the percussion hardware allows custom placement locations for each drummer and each drummer's corresponding custom drum kit setup.

Figure 8B:
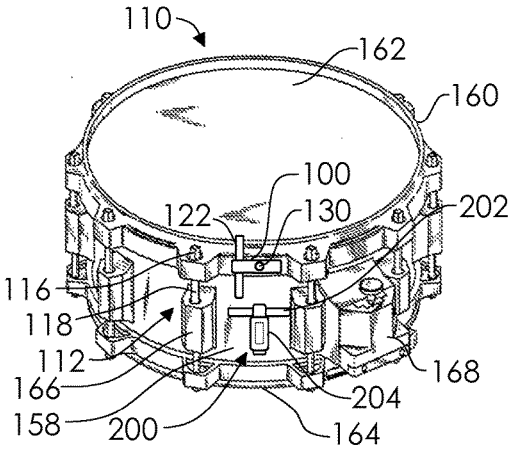
FIG. 8B is a perspective view of a snare drum according to an embodiment of the disclosure.

FIG. 8B illustrates a snare drum 110 having a ferrous metal shell 158. A first drum rim 160 is configured to hold a first drum head 162 to the shell 158 and a second drum rim 164 is configured to hold a second drum head (not shown) to the shell 158. A plurality of tuning assemblies 112 each comprise a lug 166 and tension rod 118 having a square-shaped head 116. The embodiment of FIG. 8B includes both an upper and a lower tension rod 118 for each lug. A snare strainer mechanism 168 controls how much a strainer (not shown) is applied to the second drum rim (not shown). The drum tuning key 100 is magnetically coupled to the first drum rim 160 at a location that may be located near a particular portion of the first drum head 162 which is not typically struck by the percussionist, for example a portion that is more remote from the percussionist, or that is towards the bass drum. Though a snare drum stand is not shown in FIG. 8B, snare drums 110 are often used with a stand, and it is also possible for the percussionist, drum tech, etc. to place the magnetically couple the drum tuning key 100 on a portion of the snare drum stand. The drum tuning key 100 may also be magnetically coupled to the shell of any drum, when the shell comprises a ferrous metal, like the ferrous metal shell 158 of the snare drum 110.

Figure 9:
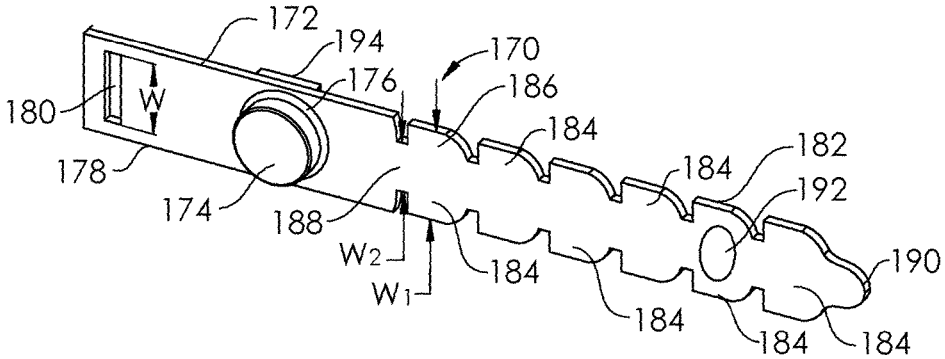
FIG. 9 is a perspective view of a magnetic band according to an embodiment of the disclosure.

FIG. 9 illustrates a magnetic band 170 configured for attaching to a stand or other piece of percussion hardware. The magnetic band 170 includes a strip portion 172 for securing around a portion of percussion hardware a magnet 174, which is carried by the strip portion 172. The magnet 174 may be directly secured to the strip portion 172 by adhesive of epoxy bonding, or may snap, friction fit or otherwise attach to a housing portion 176 carried by the strip portion 172. The magnet 174 is shown in FIG. 8B is a cylindrical, axially magnetized magnet with either a north pole or a south pole facing externally, but other magnet shapes are also contemplated, such as those having square or rectangular faces. The magnet 174 may comprise any of the magnet materials, grades and strengths described in relation to the magnet 130. The strip portion 172 of the magnetic band 170 may comprise a rubber, such as silicone rubber, EPDM, or may include other resilient materials such as thermoplastic elastomers such as PEBAX® (registered trademark of Arkema France Corporation, Comlombes, France) or Santoprene® (registered trademark of Exxon Mobil Corporation New Jersey, Irvine, Tex., USA). The strip portion 172 may be die cut or laser cut from a sheet of material, or may be compression or injection molded. The strip portion 172 may even be cast or formed in an additive manufacturing (AM) process. The strip portion 172 includes a first end 178 which includes a slot 180 and a second end 182 having a linear series of shaped snap sections 184, each having a first section 186 whose width $W_1$ is greater than the width W of the slot 180 and a second section 188 whose width $W_2$ is less than the width W of the slot 180. To secure the magnetic band 170 around a portion of a piece of percussion hardware, the strip portion 172 is wrapped around the piece of percussion hardware with one face of the magnet 174 extending outward, and an extreme end portion 190 is inserted into the slot 180 and the appropriate number of snap sections 184 are pulled through the slot 180, until the strip portion 172 is securely surrounding the portion of percussion hardware. Turning back to FIG. 8A, the magnetic band is shown in place secured around the tubular member 152 of the hi-hat stand 146. As in this embodiment, the magnet is secured to the piece of percussion hardware, standard drum tuning keys (i.e., without magnets) may be used, as a significant number of these drum tuning keys comprise ferrous metal and will be magnetically attracted to the magnet 174 of the magnetic band 170. Again, the magnet 174 of the magnetic band 170 may be placed in a location that is efficient and accessible for the percussionist. In some embodiments, instead of the snap sections 184, the magnetic band 170 instead comprises a Velcro® closure 192, 194 (registered trademark of Velcro Industries B.V., Castorweg, Curacao, Netherlands). In other embodiments, the magnetic band instead has snaps or pressure sensitive adhesive securement.

In one embodiment of the disclosure, a device for magnetic attachment of a percussion implement includes a resilient member configured to be removably securable to a portion of musical equipment, such that when secured, the member at least partially encircles the portion, and a magnet secured to the member. In some embodiments, the member includes rubber. In some embodiment, the member includes silicone rubber. In some embodiments, the member includes a closure element having a slot and a one or more shaped sections configured to snap into the slot. In some embodiments, the member includes a closure element including Velcro. In some embodiments, the member includes a closure element including a snap. In some embodiments, the member includes a closure element including a pressure-sensitive adhesive. A circular magnet 174 is shown in FIG. 9, though any number of shapes may be used. In one embodiment, a total geometric volume of the magnet 174 is a least about 200 $mm^3$. In another embodiment, a total geometric volume of the magnet 174 is between about 250 $mm^3$ and about 350 $mm^3$.

Figure 10:
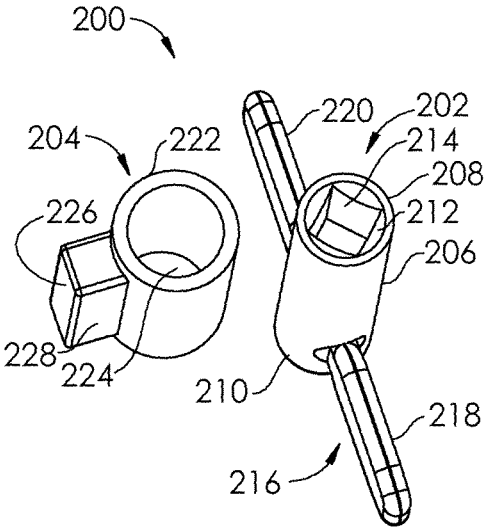
FIG. 10 is a perspective view of a drum tuning key and magnetic sleeve assembly according to an embodiment of the disclosure.

FIG. 10 illustrates a drum tuning key system 200 including a drum tuning key 202 and a magnetic sleeve 204. The drum tuning key 202 includes a body 206 having a first end 208 and a second end 210. The first end 208 includes an interface 212 which includes a cavity 214 having a substantially square cross-section. The second end 210 includes a radially-extending portion 216 comprising a first wing 218 and a second wing 220. The drum tuning key 202 is a standard drum tuning key, and may be configured from magnetic or non-magnetic materials including ferrous or non-ferrous metals. The magnetic sleeve 204 includes a hollow resilient sleeve 222 which has a cavity 224 and is configured to be fit snugly over an outer portion 224 of the body 206 of the drum tuning key 202. A magnet 226 is secured to the hollow resilient sleeve 222, for example, buy adhesive or epoxy bonding, or through a snap or friction with within a housing 228, which is coupled to the hollow resilient sleeve 222. A rectangular magnet 226 is shown in FIG. 10, though any number of shapes may be used. In one embodiment, a total geometric volume of the magnet 226 is a least about 200 $mm^3$. In another embodiment, a total geometric volume of the magnet 226 is between about 250 $mm^3$ and about 350 $mm^3$.

Figure 11:
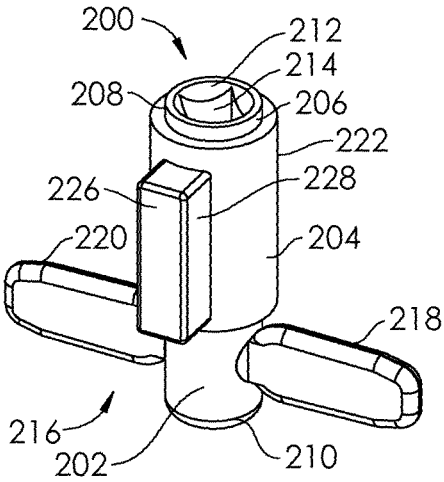
FIG. 11 is a perspective view of the magnetic sleeve and drum tuning key of FIG. 10 coupled together.

In FIG. 11, the magnetic sleeve 204 has been placed securely over the body 206 of the drum tuning key 202, so that the drum tuning key system 200 operates similarly to the drum tuning key 100 of FIG. 1. At any time, the magnetic sleeve 204 may be removed from the drum tuning key 202 and placed over a different drum tuning key. The hollow resilient sleeve 222 of the magnetic sleeve 204 may comprise a rubber, such as silicone rubber, EPDM, or may include other resilient materials such as thermoplastic elastomers such as PEBAX® or Santoprene®. The longitudinal friction and the rotational friction between the hollow resilient sleeve 222 and the body 206 is sufficient so that the drum tuning key 202 is snugly held and cannot fall out of the magnetic sleeve 204 due to its own weight. Additionally, if the drum tuning key 202 comprises a magnetic material such as a ferrous metal, there may be some additional frictional force holding the magnetic sleeve 204 and the drum tuning key 202 together due to the magnetically-applied normal force between the magnet 226 and the body 206 (or other portion of the drum tuning key 202). Returning to FIG. 8B, a drum tuning key system 200 is shown magnetically coupled to the ferrous metal shell 158. Again, the drum tuning key system 200 may be purposely placed at a portion that is more remote from the percussionist so that it is not disturbed by playing, but within reach of the percussionist. Additionally, the drum tuning key system 200, and the drum tuning key 100, are configured to magnetically coupled to a belt buckle, or a key chain commonly used by musicians or drum techs, as well as any other clothing item or luggage with an appropriately sized (e.g., 100 grams or more) ferrous metal portion. In other embodiments, the hollow resilient sleeve 222 may be replaced by a closure mechanism, such as Velcro, snaps, or pressure-sensitive adhesive strips.

In one embodiment of the disclosure, a device for magnetic attachment of a percussion implement includes a resilient sleeve configured to grip a body of the percussion implement, and a magnet coupled to the resilient sleeve. In some embodiments, the resilient sleeve is configured to grip the body with a friction fit. In some embodiment, the resilient sleeve includes a closure mechanism. In some embodiment, the closure mechanism includes Velcro. In some embodiment, the closure mechanism includes at least one snap. In some embodiment, the closure mechanism includes pressure-sensitive adhesive.

In the case that a percussionist would like to couple a drum tuning key (or other item) to a portion of equipment that includes a ferrous metal that is sufficiently magnetic, the percussionist may choose any of the embodiments of FIG. 1, 9, or 10. In the case that a percussionist would like to couple a drum tuning key (or other item) to a portion of equipment that does not a ferrous metal and/or is not sufficiently magnetic, the percussionist may still choose the embodiment of FIG. 9. It is even possible for the percussionist to use either the embodiment of FIG. 1 or the embodiment of FIG. 10 in conjunction with the embodiment of FIG. 9, as long as the north pole of one magnet is coupled to the south pole of the other magnet. This may be a desirable combination in cases in which a very large coupling force is desired, for example if the implement to be secured is significantly heavy.

Though the embodiments described herein are primarily related to drum tuning keys, it is contemplated that other accessories or small instruments may benefit by similar construction utilizing magnets. For example, a whistle, which may be used in some percussion related to Brazilian and other music, may be configured with a magnet as that of the embodiment of FIG. 1, or with a magnetic sleeve such as that of FIG. 10, or at least containing ferrous metal so as to engage with a magnet such as that of FIG. 9.

While embodiments have been shown and described, various modifications may be made without departing from the scope of the inventive concepts disclosed herein.

What is claimed is:

1. A drum tuning key comprising:

a body having a longitudinal axis, a first end and a second end, the first end comprising a keyed interface configured to releaseably engage an element of a tuning assembly of a drum for cooperative rotation therewith and the second end comprising a radially-extending portion configured to be manipulated by a user to apply a torque in relation to the longitudinal axis to operate the tuning assembly; and a magnet carried by the body and having a first end, a second end, and an axis of magnetization extending between the first end and the second end, wherein at least one of the first end or the second end of the magnet is located at or adjacent an outer surface of the body, and wherein the magnet is carried within a transverse hole passing through the body.

2. The drum tuning key of claim 1, wherein the magnet is configured to magnetically couple to drum hardware or a drum component comprising a ferrous metal such that the weight of the drum tuning key is supported.

3. A drum tuning key comprising:

a body having a longitudinal axis, a first end and a second end, the first end comprising a keyed interface configured to releaseably engage an element of a tuning assembly of a drum for cooperative rotation therewith and the second end comprising a radially-extending portion configured to be manipulated by a user to apply a torque in relation to the longitudinal axis to operate the tuning assembly; and a magnet carried by the body and having a first end, a second end, and an axis of magnetization extending between the first end and the second end, wherein at least one of the first end or the second end of the magnet is located at or adjacent an outer surface of the body, and wherein the magnet is configured to magnetically couple to drum hardware or a drum component comprising steel and having a mass of at least 100 grams.

4. A drum tuning key comprising:

a body having a longitudinal axis, a first end and a second end, the first end comprising a keyed interface configured to releaseably engage an element of a tuning assembly of a drum for cooperative rotation therewith and the second end comprising a radially-extending portion configured to be manipulated by a user to apply a torque in relation to the longitudinal axis to operate the tuning assembly; and a magnet carried by the body and having a first end, a second end, and an axis of magnetization extending between the first end and the second end, wherein at least one of the first end or the second end of the magnet is located at or adjacent an outer surface of the body, and wherein the magnet has a geometric volume of at least about 200 $mm^3$.

5. The drum tuning key of claim 4, wherein the magnet has a geometric volume of between about 250 $mm^3$ and about 350 $mm^3$.

6. A drum tuning key comprising:

a body having a longitudinal axis, a first end and a second end, the first end comprising a keyed interface configured to releaseably engage an element of a tuning assembly of a drum for cooperative rotation therewith and the second end comprising a radially-extending portion configured to be manipulated by a user to apply a torque in relation to the longitudinal axis to operate the tuning assembly; and a magnet carried by the body and having a first end, a second end, and an axis of magnetization extending between the first end and the second end, wherein at least one of the first end or the second end of the magnet is located at or adjacent an outer surface of the body, and wherein the magnet has a magnetic field strength of between about 1.0 Tesla and about 1.6 Tesla.

7. A drum tuning key comprising:

a body having a longitudinal axis, a first end and a second end, the first end comprising a keyed interface configured to releaseably engage an element of a tuning assembly of a drum for cooperative rotation therewith and the second end comprising a radially-extending portion configured to be manipulated by a user to apply a torque in relation to the longitudinal axis to operate the tuning assembly; and a magnet carried by the body and having a first end, a second end, and an axis of magnetization extending between the first end and the second end, wherein at least one of the first end or the second end of the magnet is located at or adjacent an outer surface of the body, and wherein the magnet has a grade of between 45 and 52.

8. The drum tuning key of claim 1, wherein the magnet is configured to magnetically couple to drum hardware or a drum component selected from the list consisting of a cymbal stand, a hi-hat stand, a rim of a drum, and a shell of a drum.

9. The drum tuning key of claim 1, wherein the keyed interface comprises a cavity having a substantially square cross-section.

10. The drum tuning key of claim 1, wherein the radially-extending portion comprises a first wing and a second wing, the first wing extending from the body in a first direction and the second wing extending from the body in a second direction, the second direction generally opposite the first direction.

11. A drum tuning system comprising:

a drum tuning key comprising a body having a longitudinal axis, a first end and a second end, the first end comprising a keyed interface configured to releaseably engage an element of a tuning assembly of a drum for cooperative rotation therewith and the second end comprising a radially-extending portion configured to be manipulated by a user to apply a torque in relation to the longitudinal axis to operate the tuning assembly;

a member comprising a resilient material, the member configured to be removably securable to the body, such that when secured, the member at least partially encircles the body; and a magnet secured to the member, the magnet having a first end, a second end, and an axis of magnetization extending between the first end and the second end, wherein at least one of the first end or the second end of the magnet is located at or adjacent an outer surface of the body when the member is secured to the body.

12. The drum tuning system of claim 11, wherein the member comprises an elastomer.

13. The drum tuning system of claim 12, wherein the member comprises silicone rubber.

14. A drum tuning key comprising:

a body having a longitudinal axis, a first end and a second end, the first end comprising a keyed interface configured to releaseably engage an element of a tuning assembly of a drum for cooperative rotation therewith and the second end comprising a radially-extending portion configured to be manipulated by a user to apply a torque in relation to the longitudinal axis to operate the tuning assembly; and a magnet carried by the body and having a first end, a second end, and an axis of magnetization extending between the first end and the second end, wherein at least one of the first end or the second end of the magnet is located at or adjacent an outer surface of the body, and wherein the magnet comprises an outer surface, and wherein the outer surface of the magnet is protected from the ambient environment by at least one of a coating, a plating, or a structure of non-corrosive material.

15. A drum tuning key comprising:

a body having a longitudinal axis, a first end and a second end, the first end comprising a keyed interface configured to releaseably engage an element of a tuning assembly of a drum for cooperative rotation therewith and the second end comprising a radially-extending portion configured to be manipulated by a user to apply a torque in relation to the longitudinal axis to operate the tuning assembly; and a magnet carried by the body and having a first end, a second end, and an axis of magnetization extending between the first end and the second end, wherein at least one of the first end or the second end of the magnet is located at or adjacent an outer surface of the body, and wherein the magnet has a pull of at least five pounds.

16. The drum tuning key of claim 15, wherein the magnet has a pull of at least nine pounds.

17. The drum tuning key of claim 1, wherein the magnet is a rare earth magnet.

18. The drum tuning key of claim 7, wherein the magnet comprises Neodymium-Iron-Boron.

19. The drum tuning key of claim 1, wherein the axis of magnetization of the magnet is substantially perpendicular to the longitudinal axis of the body.

20. The drum tuning key of claim 1, wherein the axis of magnetization of the magnet does not pass through the second end of the body.

21. The drum tuning key of claim 1, wherein the magnet is secured to the body by an adhesive or epoxy.

22. The drum tuning key of claim 1, wherein the magnet is friction fit or mechanically engaged with the transverse cavity.

23. A drum tuning system comprising:

a drum tuning key comprising a body comprising a ferrous metal and having a longitudinal axis, a first end and a second end, the first end comprising a keyed interface configured to releaseably engage an element of a tuning assembly of a drum for cooperative rotation therewith and the second end comprising a radially-extending portion configured to be manipulated by a user to apply a torque in relation to the longitudinal axis to operate the tuning assembly;

a flexible band having a first end and a second end and configured to be securable to drum hardware or a drum component; and a magnet carried by the band, the magnet having a first end, a second end, and an axis of magnetization extending between the first end and the second end, wherein at least one of the first end or the second end of the magnet is configured to magnetically engage the body of the drum tuning key.

24. The drum tuning system of claim 23, wherein the band comprises an elastomer.

25. The drum tuning system of claim 24, wherein the band comprises silicone rubber.

26. The drum tuning system of claim 23, wherein the first end of the band is securable to the second end of the band.

27. The drum tuning key of claim 3, wherein the axis of magnetization of the magnet does not pass through the second end of the body.

28. The drum tuning key of claim 4, wherein the axis of magnetization of the magnet does not pass through the second end of the body.

29. The drum tuning key of claim 14, wherein the axis of magnetization of the magnet does not pass through the second end of the body.

30. The drum tuning key of claim 15, wherein the axis of magnetization of the magnet does not pass through the second end of the body.

31. A drum tuning key comprising:

a body having a longitudinal axis, a first end and a second end, the first end comprising a keyed interface configured to releaseably engage an element of a tuning assembly of a drum for cooperative rotation therewith and the second end comprising a radially-extending portion configured to be manipulated by a user to apply a torque in relation to the longitudinal axis to operate the tuning assembly; and a magnet carried by the body and having a first end, a second end, and an axis of magnetization extending between the first end and the second end, wherein at least one of the first end or the second end of the magnet is located at or adjacent an outer surface of the body, and wherein the magnet is the only magnet carried by the body.

32. The drum tuning key of claim 31, wherein the axis of magnetization of the magnet does not pass through the second end of the body.

33. The drum tuning key of claim 1, wherein the magnet substantially fills the transverse hole.

* * * * *